United States Patent [19]

Schumacher et al.

[11] Patent Number: 4,993,249

[45] Date of Patent: Feb. 19, 1991

[54] ADJUSTING ELEMENT FOR THE UNLOCKING, LOCKING AND BREAK-IN SECURITY OF A DOOR OR LID LOCK

[75] Inventors: Josef Schumacher, Reutlingen; Dieter Feichtiger, Aidlingen; Peter Robitschko; Klaus Claar, both of Sindelfingen; Hans Deischl, Jettingen; Rainer Seitz, Frankfurt, all of Fed. Rep. of Germany

[73] Assignees: Daimler-Benz AG; VDO Adolf Schindling AG, both of Fed. Rep. of Germany

[21] Appl. No.: 308,467

[22] Filed: Feb. 10, 1989

[30] Foreign Application Priority Data

Feb. 17, 1988 [DE] Fed. Rep. of Germany ..... 3804838

[51] Int. Cl.[5] ..... E05B 65/38

[52] U.S. Cl. ..... 70/264; 292/201; 292/336.3

[58] Field of Search ..... 70/264, 275, 279, 237; 292/201, 336.3

[56] References Cited

U.S. PATENT DOCUMENTS

| | | | |
|---|---|---|---|
| 4,269,440 | 5/1981 | Gelhard | 292/201 X |
| 4,779,912 | 10/1988 | Ikeda et al. | 292/336.3 |
| 4,802,350 | 2/1989 | Periou | 292/201 X |

FOREIGN PATENT DOCUMENTS

| | | | |
|---|---|---|---|
| 0058281 | 8/1982 | European Pat. Off. | 70/237 |
| 3120778 | 12/1982 | Fed. Rep. of Germany . | |
| 3500550 | 10/1985 | Fed. Rep. of Germany . | |
| 1336020 | 11/1973 | United Kingdom | 292/201 |

*Primary Examiner*—Lloyd A. Gall

*Attorney, Agent, or Firm*—Evenson, Wands, Edwards, Lenahan & McKeown

[57] ABSTRACT

A mechanical unlocking arrangement is integrated in an adjusting element for the unlocking and locking of a door- or lid-lock which in addition to a main adjusting drive includes a further power-actuated security-adjusting drive for blocking the adjusting member of the main adjusting drive in the position keeping the lock locked by means of a locking member; the mechanical unlocking arrangement thereby enables a release of the blocked adjusting member without power-assist.

19 Claims, 3 Drawing Sheets

ADJUSTING ELEMENT FOR THE UNLOCKING, LOCKING AND BREAK-IN SECURITY OF A DOOR OR LID LOCK

BACKGROUND OF THE INVENTION

The present invention relates to an adjusting element for unlocking and locking a door- or lid-lock, especially in a motor vehicle with a central locking installation, by means of a power-actuatable main adjusting drive having an adjusting member displaceable by the latter, which is adapted to be coupled with a latching lever of the door or lid lock and at least with an interior lock actuation, and for the purpose of anti-theft protection of the door or lid lock against unlocking thereof without key or power-assist by means of a power-actuatable security-adjusting drive actuatable independently of the main adjusting drive and having a locking member which driven by the security-adjusting drive is adapted to be brought into and out of form-locking engagement with the adjusting member blocking the latching lever and the interior lock actuation.

An adjusting element of the aforementioned type is known (DE-OS 31 20 778) and has the function to lock an auxiliary door lock in a motor vehicle with central locking system selectively against opening from the outside or against opening from the inside and outside. A similar arrangement is additionally known from the DE-OS 32 10 924.

An adjusting member connected with a main adjusting drive can thus be blocked by a power-actuated security adjusting drive by means of a blocking member in the position in which the coordinated door lock is locked. As the adjusting member is fixedly connected with the latching lever of the door lock in a conventional manner the lock can no longer be unlocked without prior release of the adjusting member—which can be effected with the known adjusting elements only by power-assisted actuation of the security-adjusting drive.

The present invention is concerned with the task to so construct an adjusting element of the aforementioned type having a blocking of the actuated adjusting member that also a release of the adjusting member and an unlocking of the door or lid lock out of the blocked condition is rendered possible independent of the power-actuation.

The underlying problems are solved according to the present invention in that an unlocking arrangement is provided movable relative to the blocked adjusting member and to the locking member disposed therewith in the blocking engagement, which is to be coupled with a lock cylinder additionally coordinated to the door or lid lock, whereby the unlocking arrangement, with the mentioned relative movement adapted to be initiated by key actuation of the lock cylinder forces the locking member mechanically into a position releasing the adjusting member, and in that a force storage device is provided absorbing the force during the mentioned relative movement between the adjusting member and the unlocking arrangement, which releases the absorbed force to the adjusting member upon release of the adjusting member for a movement of the adjusting member unlocking the door or lid lock.

A simple mechanical unlocking arrangement is coupled with the adjusting element and to a lock cylinder in a known manner. A possibility independent of the power-generation is therewith given to an authorized vehicle user who is in the possession of a fitting vehicle key, to be able to enter the vehicle.

The unlocking arrangement can be constructed particularly advantageous and compact by an arrangement coaxial to the adjusting member of its actuating rod extended out of the adjusting element to the lock cylinder, respectively, lock.

BRIEF DESCRIPTION OF THE DRAWINGS

These and other objects, features and advantages of the present invention will become more apparent from the following description when taken in connection with the accompanying drawing which shows, for purposes of illustration only, one embodiment in accordance with the present invention, and wherein.

DETAILED DESCRIPTION OF THE DRAWINGS

Figure 1:
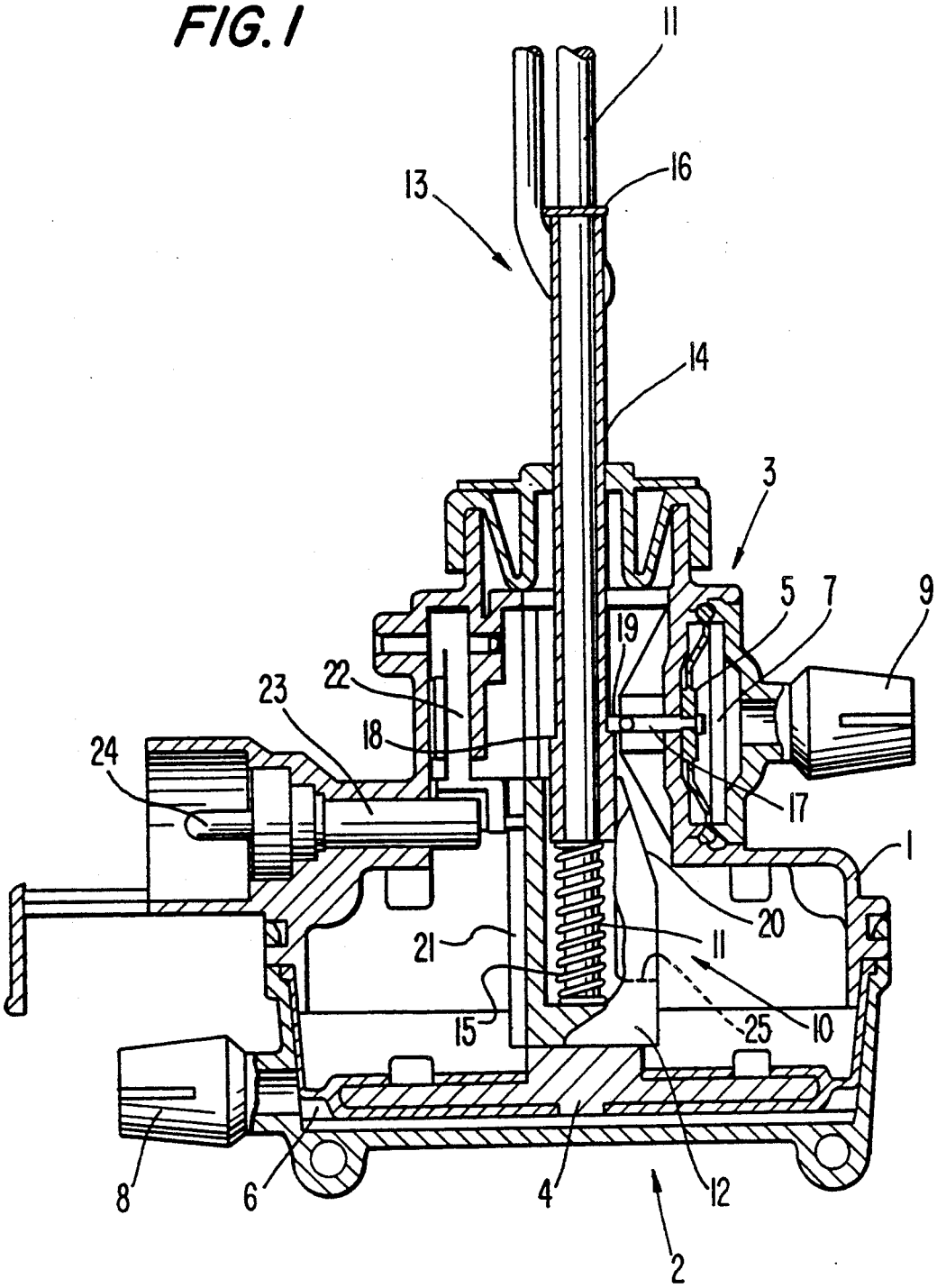
FIG. 1 is a cross-sectional view through the entire adjusting in accordance with the present invention.

Referring now to the drawing wherein like reference numerals are used throughout the various views to designate like parts, a main adjusting drive generally designated by reference numeral 2 and a security-adjusting drive generally designated by reference numeral 3 are arranged in a housing 1 of the adjusting element. Both adjusting drives include diaphragm pistons 4, respectively, 5 movable to and fro by means of pneumatic excess pressure or vacuum and mechanically displaceable in the rest or normal condition, and having each one working chamber 6, respectively, 7 and one supply connection 8, respectively, 9 each.

An example of a prior art pneumatically operated central locking and security arrangement of he general type and operation herein described is shown in German Patent Document DE 31 20 778 Al, referred to above.

An unlocking arrangement generally designated by reference numeral 10 is fixedly connected with the main adjusting drive 2 and includes an actuating rod 11 and a sleeve 12 arranged concentric with respect to the same.

An adjusting member 13 additionally displaceable by the main adjusting drive 2 is constructed within a limited longitudinal section as tubular sleeve 14 which is also arranged concentrically to the actuating rod 11.

The tubular sleeve 14 is pre-stressed against an abutment 16 on the actuating rod 11 by a force storage device 15 constructed as coil compression spring--which is supported at the main adjusting drive 2. An axial relative movement is possible between the tubular sleeve 14 and the actuating rod 11 against the spring force, which is limited to the distance between the illustrated installed length of the coil compression spring and the blocking length thereof.

A locking member 17 is fixedly connected with the security adjusting drive 3. In the illustrated position, the locking member 17 is in form-locking engagement with an abutment 18 on the surface of the tubular sleeve 14. Additionally, the locking member 17 includes an unlocking lever 19 which protrudes at an angle from the longitudinal axis of the longitudinally displaceable locking member 17. A guide surface 20 is formed-on at the sleeve 12 which in the course of a relative movement of the actuating rod 11 with respect to the locking member 17 is brought into contact with the unlocking lever 19 thereof and by way of the same displaces the locking member 17 together with the security-adjusting drive 3 which is movable without power-assist in the rest or normal condition thereof, mechanically into a position releasing the tubular sleeve 14 and therewith the adjusting member 13. A phase of this operation is illustrated in FIG. 2.

A guide cam 21 is additionally provided at the sleeve 12. A shifting lever 22 pivotally supported in the housing 1 is displaced during each movement of the main adjusting drive 2 by the guide cam 21 about its pivot axis located in the plane of the drawing. The shifting lever 22 in turn actuates a change-over switch 23 of known construction in a direction disposed perpendicular to the plane of the drawing. The changeover switch 23 is reliably brought into a respective end position with the assistance of an over dead-center helper spring, whereby the end position corresponds to one of the two extreme positions of the main adjusting drive 2. An electrical multi-plug contact 24 is provided at the housing 1 for the change-over switch 23.

Figure 2:
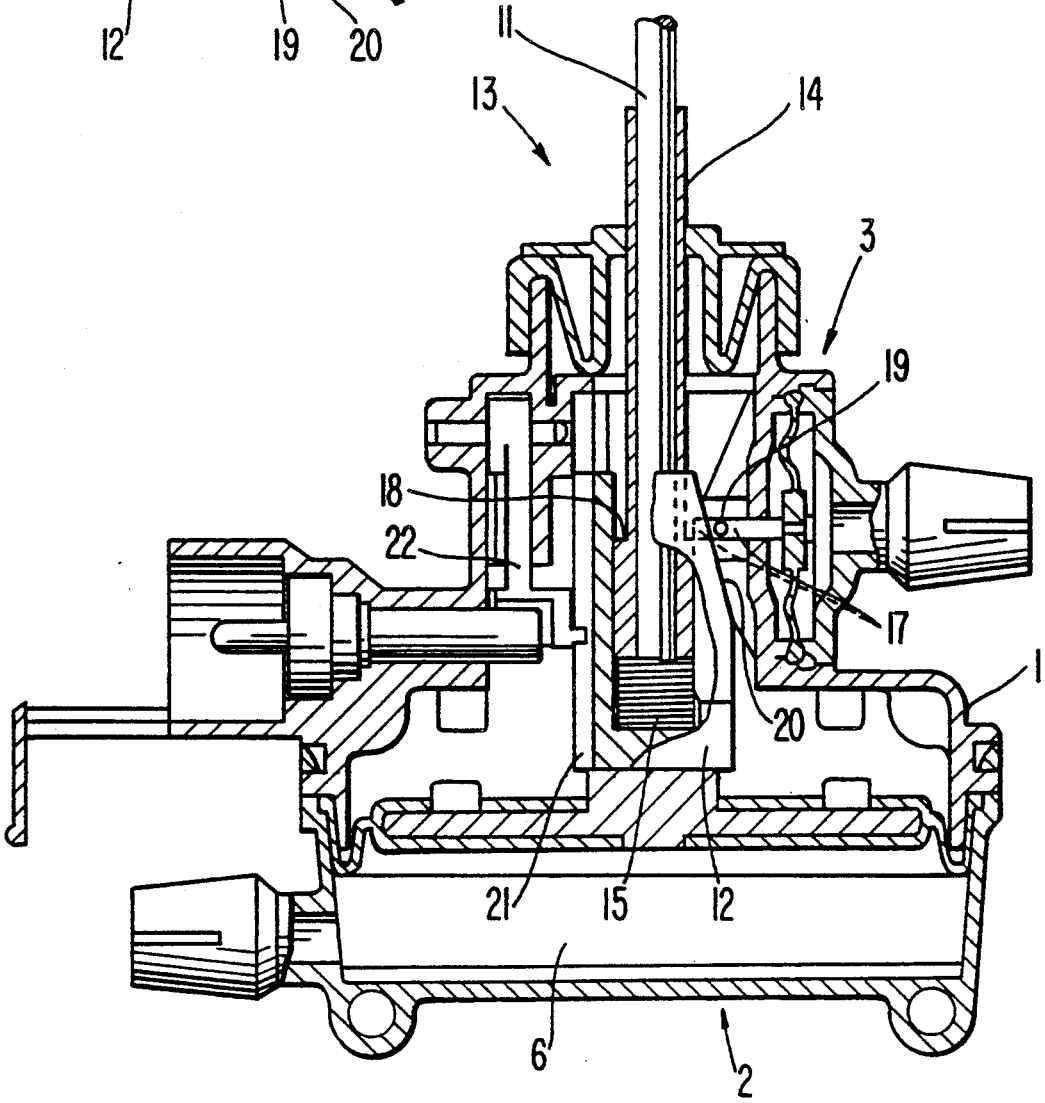
FIG. 2 is a cross-sectional view, similar to FIG. 1, and illustrating a phase of the release operation of the blocked adjusting member.
Figure 4:
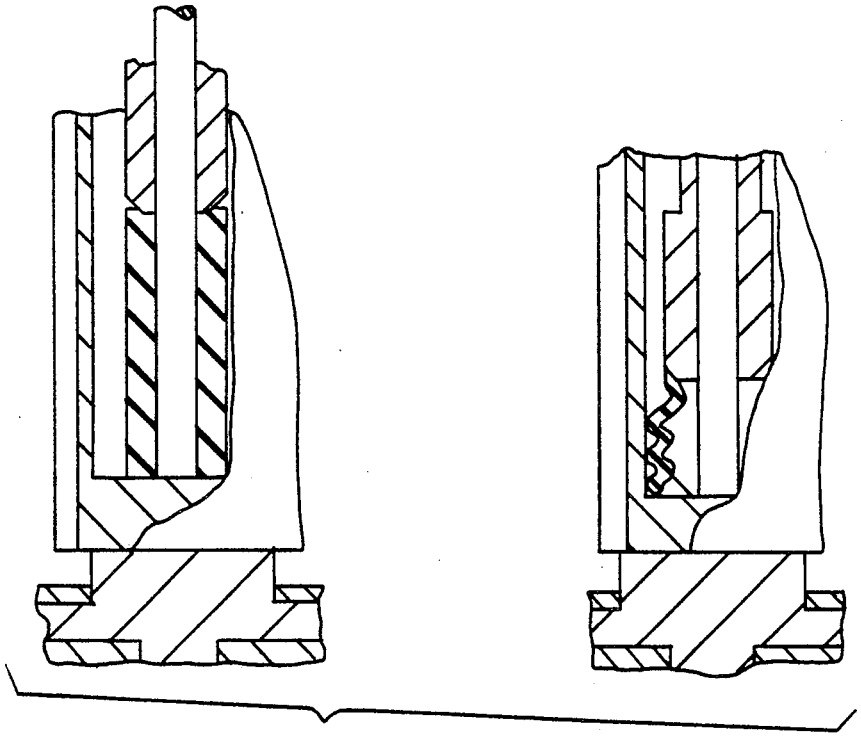
FIG. 4 illustrates a rubber elastic spring element embodiment.
Figure 5:
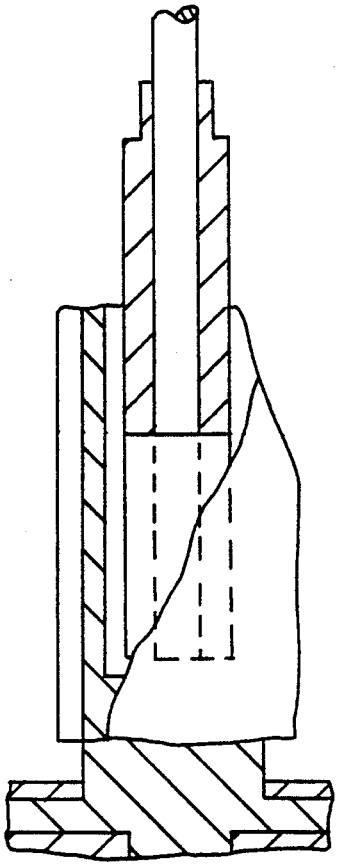
FIG. 5 illustrates a gas pressure spring embodiment.

Only the essential components of the adjusting element are designated in FIG. 2 with the reference numerals corresponding to those of FIG. 1.

In FIG. 2 is illustrated the phase of the release operation in which the locking member 17 has just been brought out of the form-locking engagement with the abutment 18 of the tubular bushing 14. Already prior thereto, the actuating rod 11 has been displaced so far within the previously blocked tubular bushing 14 that the unlocking lever 19 slides up on the ramp-shaped guide surface 20 and is pushed back and that the coil compression spring 15 is compressed into its blocking length.

At the next instant, the stressed coil compression spring 15 will displace the released tubular bushing 14 and therewith the adjusting member 13 upwardly so that the locked door or lid lock can now be unlocked.

The force storage device 15 must be constructed so stiff that during the unlocking of the lock as a rule—that is after preceding power-actuated release of the tubular sleeve 14 by the locking member 17—no significant relative displacement between the actuating rod 11, respectively, the main adjusting drive 2 and the tubular bushing 14, respectively, the adjusting member 13 is to be expected.

Figure 3:
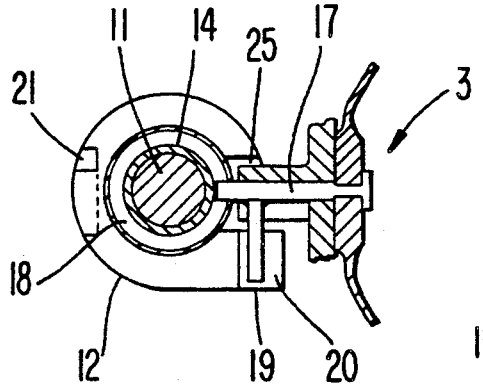
FIG. 3 is a transverse cross-sectional view of a detail of the unlocking arrangement and of the locking member as viewed in plan view.

For purposes of illustrating the unlocking arrangement, FIG. 3 shows a slightly enlarged detailed plan view of the elements cooperating during the release of the blocked adjusting member. The cross-sectional plane lies in FIG. 1 perpendicularly to the drawing plane and in the axis of the locking member 17.

The coaxial arrangement of the actuating rod 11, of the tubular bushing 14 and of the sleeve 12 is illustrated in FIG. 3. Also, the configuration of the guide cam 21 in the sleeve 12 can be seen more clearly in this figure as also the arrangement of the unlocking lever 19 of the locking member 17. It should be noted that the locking member 17, as illustrated, is axially guided over a greatest possible length with smallest tolerances in order to achieve a high security against forcible tampering. A recess 25 is provided in the sleeve 12 in order that the same can be displaced without contact with the locking member 17, respectively, the axial guidance thereof.

Of course, the unlocking arrangement according to the present invention can also be used differing from the illustrated embodiment for other types of adjusting drives freely operable in the rest condition, for example, with electromagnetic drives.

Furthermore, the form-locking engagement between the adjusting member and the locking member can also be constructed differently from that illustrated, for example, with bore and plug or with a fork-shaped locking member.

Furthermore, in addition to coil springs as force storage device, also gas pressure springs or rubber-elastic spring elements can be used with the present invention.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. An arrangement for unlocking and locking of a door or lid lock means comprising:

power-actuatable main adjusting drive means including an adjusting member movable by the main adjusting drive means, said adjusting member being coupled with a latching lever of said lock means and with at least an interior lock actuating means, power-actuatable security-adjusting drive means, actuatable independently of the main adjusting drive means, to prevent unlocking of said lock means without key or power-assist, said security-adjusting drive means including a locking member actuatable by the security-adjusting drive means to be brought into and out of a form-locking engagement with the adjusting member, thereby blocking said adjusting member and said latching lever and the interior lock actuating means coupled therewith, unlocking means, operatively coupled with a lock cylinder of the lock means, movable relative to said adjusting member and to said locking member in response to key actuation of the lock cylinder, said unlocking means being adapted to force the locking member mechanically into a position releasing the adjusting member during said relative movement initiated by key actuating of the lock cylinder, and force storage means adapted to absorb a force generated during the mentioned relative movement between the adjusting member and the unlocking means, said force storage means releasing the absorbed force to the adjusting member after release of the adjusting member, for movement of the adjusting member unlocking the lock means.

2. The arrangement according to claim 20, wherein the adjusting member is constructed at least within a limited longitudinal section as tubular bushing, an actuating rod of the unlocking means being arranged coaxially in the tubular bushing of the adjusting member, the actuating rod of the unlocking means being operatively connected with a guide surface means and being movable within a limited distance substantially parallel to the adjusting member, whereby the guide surface means is brought by mean of the locking member at least indirectly into a contact causing the locking member to come out of engagement with the adjusting member, and the force storage means being constructed as a spring prestressing the adjusting member and the actuating rod with respect to one another.

3. The arrangement according to claim 2, wherein the actuating rod is securely connected with the main adjusting drive means movable without power-assist in an unenergized condition, and wherein the force storage means is arranged between the tubular bushing of the adjusting member and the main adjusting drive means concentrically to the actuating rod, is supported at the main adjusting drive means and prestresses the tubular bushing against an abutment on the actuating rod.

4. The arrangement according to claim 2, wherein the main adjusting drive means and the security adjusting drive means together with the locking member are arranged in a common housing means, out of which only the adjusting member and the actuating rod are extended as movable parts.

5. The arrangement according to claim 2, wherein the locking member operable to be brought directly into blocking engagement with an abutment of the tubular bushing of the adjusting member includes an unlocking lever with which the guide surface means of the unlocking means is operable to be brought into contact.

6. The arrangement according to claim 3, wherein the guide surface means is formed-on at a sleeve arranged concentrically to the actuating rod and securely connected with the same, and wherein the sleeve further includes a guide cam for a switch lever which switches an electric switch additionally coordinated to the main adjusting drive means depending on the prevailing extreme position of the main adjusting drive means—corresponding to either the locked or unlocked condition of the lock means—into switching positions predetermined by the guide cam moved synchronously with the actuating rod and the main adjusting drive means.

7. The arrangement according to claim 20, wherein both the main adjusting drive means as also the security adjusting drive means are constructed as diaphragm pistons each adjustable by selective excess pressure and vacuum actuation and including one working chamber each.

8. The arrangement according to claim 2, wherein the force storage means is constructed as rubber-elastic spring element.

9. The arrangement according to claim 2, wherein the force storage means is constructed as gas pressure spring.

10. The arrangement for a motor vehicle according to claim 1, further comprising a central locking system for the lock means.

11. The arrangement according to claim 3, wherein the main adjusting drive means and the security adjusting drive means together with the locking member are arranged in a common housing means, out of which only the adjusting member and the actuating rod are extended as movable parts.

12. The arrangement according to claim 11, wherein the locking member operable to be brought directly into blocking engagement with an abutment of the tubular bushing of the adjusting member includes an unlocking lever with which the guide surface means of the unlocking means is operable to be brought into contact.

13. The arrangement according to claim 12, wherein the guide surface means is formed-on at a sleeve arranged concentrically to the actuating rod and securely connected with the same, and wherein the sleeve further includes a guide cam for a switch lever which switches an electric switch additionally coordinated to the main adjusting drive means depending on the prevailing extreme position of the main adjusting drive means—corresponding to either the locked or unlocked condition of the lock means—into switching positions predetermined by the guide cam moved synchronously with the actuating rod and the main adjusting drive means.

14. The arrangement according to claim 13, wherein both the main adjusting drive means as also the security adjusting drive means are constructed as diaphragm pistons each adjustable by selective excess pressure and vacuum actuation and including one working chamber each.

15. The arrangement for a motor vehicle according to claim 14, further comprising a central locking system for the lock means.

16. The arrangement according to claim 3, wherein the force storage means is constructed a coil compression spring.

17. The arrangement according to claim 3, wherein the force storage means is constructed as rubber-elastic spring element.

18. The arrangement according to claim 3, wherein the force storage means is constructed as gas pressure spring.

19. The arrangement according to claim 16, wherein the locking member operable to be brought directly into blocking engagement with an abutment of the tubular bushing of the adjusting member includes an unlocking lever with which the guide surface means of the unlocking means is operable to be brought into contact.

* * * * *